US011987931B2

(12) United States Patent
Poruthoor et al.

(10) Patent No.: US 11,987,931 B2
(45) Date of Patent: May 21, 2024

(54) CLEANSING SUBSTRATE WITH SYNCHRONIZED PRINTED AND EXPANDED TEXTURE

(71) Applicant: Kimberly-Clark Worldwide, Inc., Neenah, WI (US)

(72) Inventors: Simon K. Poruthoor, Alpharetta, GA (US); Christopher C. Creagan, Roswell, GA (US); Nathan J. Vogel, Neenah, WI (US); Jenna L. Bednar, New Milford, CT (US); Amanda Thelen, Greenville, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 926 days.

(21) Appl. No.: 16/970,907

(22) PCT Filed: Feb. 19, 2019

(86) PCT No.: PCT/US2019/018505
§ 371 (c)(1),
(2) Date: Aug. 18, 2020

(87) PCT Pub. No.: WO2019/161366
PCT Pub. Date: Aug. 22, 2019

(65) Prior Publication Data

US 2020/0385923 A1 Dec. 10, 2020

Related U.S. Application Data

(60) Provisional application No. 62/632,313, filed on Feb. 19, 2018.

(51) Int. Cl.
*D06P 5/00* (2006.01)
*D04H 13/00* (2006.01)
(Continued)

(52) U.S. Cl.
CPC ..... *D06P 5/30* (2013.01); *D04H 13/00* (2013.01); *D06P 5/001* (2013.01); *D06P 5/2077* (2013.01)

(58) Field of Classification Search
CPC ..... D06P 5/30; D06P 5/001; D06P 5/2077; D06P 1/965; D06P 5/20; D04H 13/00;
(Continued)

(56) References Cited

U.S. PATENT DOCUMENTS 5,325,781 A 7/1994 Dupont et al.
5,827,255 A 10/1998 Crainic
(Continued)

FOREIGN PATENT DOCUMENTS

EP 1266600 A1 * 12/2002 ..... A47K 10/42
JP 2003170539 A 6/2003
(Continued)

OTHER PUBLICATIONS

Weller, C., "Disposable diapers are genius, and engineering explains why", Jul. 2, 2016, https://www.businessinsider.com/disposable-diapers-are-genius-and-engineering-explains-why-2016-7?r=US&IR=T&utm_.

(Continued)

*Primary Examiner* — Eisa B Elhilo

(57) ABSTRACT

The current disclosure provides for a woven or nonwoven textured substrate that is stable in water based solutions. The textured substrate is generated by a controlled placement of ink on to portions of the surface and/or between layers of the textured substrate which is then followed by heat activation which expands the ink to puff out where the ink was applied to the textured substrate.

16 Claims, 7 Drawing Sheets

(51) Int. Cl.
*D06P 5/20* (2006.01)
*D06P 5/30* (2006.01)

(58) Field of Classification Search
CPC ..... D04H 1/26; D04H 5/08; D06M 23/04; D06M 23/14; D06M 23/16
USPC ..... 8/445
See application file for complete search history.

(56) References Cited

U.S. PATENT DOCUMENTS

| | | | | |
|---|---|---|---|---|
| 6,105,502 | A | 8/2000 | Wagner et al. | |
| 6,623,532 | B2 * | 9/2003 | Nakamura | D06P 5/30 8/930 |
| 6,656,228 | B1 * | 12/2003 | Sherwin | D06P 5/30 8/188 |
| 7,335,237 | B2 * | 2/2008 | Watanabe | D06P 5/30 8/445 |
| 7,956,096 | B2 | 6/2011 | Nordin et al. | |
| 8,740,869 | B2 | 6/2014 | Velazquez et al. | |
| 8,932,706 | B2 | 1/2015 | Laprade et al. | |
| 8,987,544 | B2 | 3/2015 | Poruthoor et al. | |
| 2002/0146548 | A1 | 10/2002 | Forry et al. | |
| 2005/0170150 | A1 * | 8/2005 | Tomarchio | B41M 7/0027 442/164 |
| 2007/0226919 | A1 * | 10/2007 | Mheidle | D06P 5/30 8/445 |
| 2007/0265591 | A1 | 11/2007 | Loritz et al. | |
| 2007/0289486 | A1 | 12/2007 | Apostol et al. | |
| 2009/0293209 | A1 * | 12/2009 | Chung | D06P 1/6491 8/445 |
| 2012/0157949 | A1 | 6/2012 | Knight et al. | |
| 2012/0157952 | A1 | 6/2012 | Poruthoor et al. | |
| 2013/0261590 | A1 | 10/2013 | Drevik et al. | |
| 2014/0228796 | A1 | 8/2014 | Burvall et al. | |
| 2015/0112293 | A1 | 4/2015 | Gust et al. | |
| 2015/0147539 | A1 | 5/2015 | Thomas et al. | |

FOREIGN PATENT DOCUMENTS

| | | | |
|---|---|---|---|
| WO | 13097878 | A1 | 7/2013 |
| WO | 16085467 | A1 | 6/2016 |

OTHER PUBLICATIONS

Barman, A. et al., "An Overview on Sanitary Napkins", Retrieved Feb. 16, 2023, https://www.technicaltextile.net/articles/an-overview-on-sanitary-napkins-7850.

Catspitproductions, "How to Screen Print T Shirts With Puff Ink", available from: https://www.youtube.com/watch?v=D9yc5hbgocc.

* cited by examiner

| Connecting Letters Report | | | | |
|---|---|---|---|---|
| Level | | | | Mean |
| HIGH | A | | | 1.808 |
| LOW | | B | | 1.192 |
| CTRL | | | C | 0.766 |
| Level not connected by same letter are significantly different | | | | |

CLEANSING SUBSTRATE WITH SYNCHRONIZED PRINTED AND EXPANDED TEXTURE

This application claims priority from U.S. provisional Patent Application Ser. No. 62/632313 filed on 19 Feb. 2018, the entire contents of which are incorporated herein by reference.

TECHNICAL FIELD

The present disclosure discloses methods and apparatus for creating and retaining cloth sheet structure and fiber continuity for a wet cloth. The present disclosure also relates to a method for achieving different shapes and a large number of textured patterns for such a cloth.

BACKGROUND OF THE DISCLOSURE

A textured substrate is considered a consumer preferred feature for many applications including wiping. However, creating and retaining structure is very difficult in substrates like coform, airlaid, and other similar processes and is especially true for wet condition applications with fibers. Any structure that is made by the substrate processes is often lost or reduced when the substrate is made wet.

Cleansing cloths are designed to give the consumer a superior cleaning experience, which is especially true in moist cleansing cloths and other personal care wet wipes. Currently, flushable cleansing cloths are found to have an underwhelming texture compared to dry bath tissue. The sheet loses much of its texture when converted into the wet wipes due to the structure of the sheet and sheet fibers collapsing under pressure when moistened.

U.S. Patent publication number 2017/0306540 describes the use of expandable beads as a way to capture dry particles to give texture (by a non-printing means) thereby creating a resilient structure by a coform process. However, generating a pre-determined shape and/or specific structure distribution is an involved process.

Hence a need exists to enhance the texture of the wet wipes while maintaining wet resilient texture. The current disclosure resolves this need by applying an expandable or puff ink onto a substrate and/or between one or more substrate layers before wetting. This method of enhancing texture for cleaning can be extended beyond flushable cleansing cloths by applying it to substrates used in dry bath, baby and child care wipes, surface cleaning wipes or any cleaning products that could benefit from enhanced texture.

SUMMARY OF THE DISCLOSURE

The current disclosure provides for a woven or nonwoven substrate with texture that is stable in water based solutions. The substrate texture is generated by a controlled placement of heat-activated expanding ink on the surface of a layer and/or between layers of the substrate which is then followed by activation of an expanding (or puffing) ink by heat.

The application of an expanding ink on a woven or nonwoven substrate may be made by any of the following methods: gravure, screen printing, flexography, spray, digital and other common printing applications; the expanding or puffing ink may be applied in virtually the same ways that a traditional ink may be applied to a substrate and does not require additional precautions compared to traditional ink. The expansion or puffing occurs after heat activation wherein the activation may occur at any length of time after printing through a number of different heat sources known in the art such as but not limited to hot air, IR, hot iron, microwave, or steam. After the ink is applied to the top and/or bottom or to multiple inner layers of the substrate, the substrate is dried and then activated, wherein the inked sheet may be wetted.

In addition to improved texture, applying puffing inks is a novel way to achieve a significantly higher total caliper in the wetted substrate. The caliper of the sheet indicates the thickness of the substrate; a high caliper provides a higher quality product in most cases. Higher caliper indicates to a consumer that a substrate is less likely to tear in their hands during use and less likely to allow undesirable substances to come in contact with their hands. A higher caliper across the substrate leads the consumer to believe there is a greater possibility of successfully achieving clean without risking their sanitation compared to thinner products. Even if the increased caliper is not consistent across the substrate such as for example with raised lines with the puff inks applied, the perception is highly desirable by people holding the product in hand because the thicker parts are more noticeable.

Another analytical test used to evaluate the differences between current base sheet and applications of puffing ink is topographical imaging. The test involves taking several images in varying Z-planes to reconstruct a three-dimensional image of the surface. The differences between 3D area and 2D area may then be calculated, and the differences between samples may be analyzed. The topographical imaging is a way to measure the visual cues that may indicate a change in texture. If the imaging results can quantify a change in the topography, then a consumer will also perceive a change in texture/topography as well. This perceived change in texture would lead to a resultant sense of improved cleaning.

In a first embodiment, the present disclosure discloses a method for forming a durable textured substrate, the method comprising:

printing a design pattern on a surface wherein the surface may comprise of a top side or back side portion (or part of the top or back side of the substrate wherein the portion is defined as an area on the substrate whereby that area may be random or non-randomized) of a single layered textured substrate with an expandable ink;

drying the single layered textured substrate. This drying is done to remove water based solvents or other solvents from the ink. The drying time is dependent on various variables such as temperature of the drying apparatus, speed of the drying apparatus, airflow going through the printed design substrate portion and/or wherein the drying time is done in-line with a manufacturing process;

expanding the single layered substrate portion by activating the design pattern on the single layered textured substrate with heat.

In a second embodiment, the method according to the preceding embodiment, wherein the textured substrate is a nonwoven.

In a third embodiment, the method according to the preceding embodiments, wherein the design pattern may be circles, one or more dots, squares, stars, lines, intersecting lines, rectangles, triangles, octagons, animals, frogs, teddy bears, clouds, signs, logos, human, animal or animated characters or any other similar design patterns thereof. In an alternative embodiment, the design pattern may be a functional pattern.

In a fourth embodiment, the method according to the preceding embodiments, wherein the time in which activation may occur is from the time of drying to when the textured substrate is packaged in a final product form. More specifically, the method according to the preceding embodiments, wherein activation occurs immediately after drying. Another embodiment of the present disclosure may be wherein activation occurs when the durable textured substrate is packaged in a final product form. Also an additional embodiment of the present disclosure may be wherein activation occurs anytime between after drying and when the durable textured substrate is packaged in a final product form.

In a fifth embodiment, the method according to the preceding embodiments, wherein the expandable ink is printed in a liquid dispersion form.

In a sixth embodiment, the method according to the preceding embodiments, wherein the expandable ink is printed by spraying, screen printing, gravure, flexography, or a digital printing system.

In a seventh embodiment, the method according to the preceding embodiments, wherein the expandable ink is dried by infrared (IR), microwave, heated embossing roll, hot iron, steam, hot air, or UV radiation.

In an eighth embodiment, the method according to the preceding embodiments, wherein the substrate comprises a tissue web and/or an airlaid nonwoven web.

In a ninth embodiment, the method according to the preceding embodiments, wherein the tissue web is an uncreped through-air dried tissue web. The material of the substrate layers may also be a tissue web such as a creped through-air dried tissue web.

In a tenth embodiment, the method according to the preceding embodiments, wherein the durable textured substrate is a hydroentangled base sheet.

In an eleventh embodiment, the method according to the preceding embodiments, wherein the durable textured substrate is activated at a temperature from about 70 C to about 204 C.

In a twelfth embodiment, the method according to the preceding embodiments, wherein a wipe comprises the textured substrate.

In a thirteenth embodiment, the method according to the preceding embodiments, wherein the durable textured substrate has a caliper of at least greater than 0.6 mm after activation of the substrate. More specifically, the method according to the preceding embodiments wherein the durable textured substrate has a caliper of at least 0.1 mm.

In a fourteenth embodiment, a method for forming a durable textured substrate, wherein the method comprises:

printing a design pattern with an expandable ink onto a top side or back side of two or more layers of a substrate wherein the ink may be applied to a portion or to the entire substrate wherein the portion is defined as an area on the substrate whereby that area may be random or non-randomized;

drying the design patterned substrate;

activating the design patterned substrate with heat.

In a fifteenth embodiment, the method according to the preceding embodiments, wherein the top side or back side of two or more layers of the durable textured substrate comprises hydrophilic fibers.

In a sixteenth embodiment, the method according to the preceding embodiments, wherein at least one layer of the substrate is formed on a texture forming surface such that the layer or layers have pockets into which expandable ink is printed.

In a seventeenth embodiment, the method according to the preceding embodiments, wherein the textured substrate is a nonwoven.

In an eighteenth embodiment, the method according to the preceding embodiments, wherein the design pattern may be circles, squares, stars, dots, lines, intersecting lines, rectangles, triangles, octagons, animals, teddy bears, clouds, signs, logos, human, animal or animated characters or any other similar design patterns thereof. An alternative embodiment may encompass a functional design.

In a nineteenth embodiment, the method according to the preceding embodiments, wherein the time in which activation occurs is from the time of drying to when the textured substrate is packaged in a final product form. Another alternative embodiment would be wherein activation occurs immediately after drying. Or another embodiment of the present disclosure may be wherein activation occurs when the durable textured substrate is packaged in a final product form.

In a twentieth embodiment, the method according to the preceding embodiments, wherein the expandable ink is printed in a liquid dispersion form.

In a twenty-first embodiment, the method according to the preceding embodiments, wherein the expandable ink is printed by spraying, screen printing, gravure, flexography, or a digital printing system.

In a twenty-second embodiment, the method according to the preceding embodiments, wherein the expandable ink is dried by infrared (IR), microwave, heated embossing roll, hot iron, steam, hot air, or UV radiation.

In a twenty-third embodiment, the method according to the preceding embodiments, wherein the durable textured substrate portion wherein the portion is defined as an area on the substrate whereby that area may be random or non-randomized is activated by heating said portion at a temperature from about 70 C to about 204 C.

In a twenty-fourth embodiment, the method according to the preceding embodiments, wherein a wipe comprises the textured substrate.

In a twenty-fifth embodiment, the method according to the preceding embodiments, wherein the substrate comprises a multi-layered tissue web and/or a multilayered airlaid nonwoven web.

In a twenty-sixth embodiment, the method according to the preceding embodiments, wherein the multilayered tissue web is a multilayered uncreped through-air dried tissue web. The material of the substrate layers may also be a tissue web such as a creped through-air dried tissue web.

In a twenty-seventh embodiment, method according to the preceding embodiments, wherein the durable textured substrate is a hydroentangled base sheet.

In a twenty-eighth embodiment, the method according to the preceding embodiments, wherein the durable textured substrate has a caliper of about 0.1 mm or greater after activation of the substrate.

In a twenty-ninth embodiment, the method according to the preceding embodiments, wherein the substrate comprises at least one layer having a first density and any other layer(s) having a second density wherein the first density being at least 10%, 20% or 50% greater than the second density.

In a thirtieth embodiment, the method according to the preceding embodiments, wherein the expandable ink is applied to an outer surface of the layer(s) with the second density and not applied to the outer surface of the layer with the first density.

In a thirty-first embodiment, a textured substrate comprises a single layer wherein a design pattern is printed onto a portion of the top and/or bottom of the single layer with an expandable ink and the durable textured substrate portion of the top and/or bottom of the single layer is expanded with heat wherein the durable textured substrate portion (wherein the portion is defined as an area on the substrate whereby that area may be random or non-randomized) is activated by heating at a temperature from about 70 C to about 204 C.

In a thirty-second embodiment, the apparatus according to the preceding embodiments, wherein the design pattern may be circles, squares, stars, dots, lines, intersecting lines, rectangles, triangles, octagons, animals, teddy bears, clouds, signs, logos, human, animal or animated characters or any other similar design pattern thereof.

In a thirty-third embodiment, the apparatus according to the preceding embodiments, wherein the textured substrate is a nonwoven.

In a thirty-fourth embodiment, the apparatus according to the preceding embodiments, wherein a wipe comprises the textured substrate.

In a thirty-fifth embodiment, the apparatus according to the preceding embodiments, wherein the substrate comprises a tissue web and/or an airlaid nonwoven web.

In a thirty-sixth embodiment, the apparatus according to the preceding embodiments, wherein the substrate comprises an uncreped through-air dried tissue web or an airlaid nonwoven web. The substrate may also comprise of a creped through-air dried tissue web.

In a thirty-seventh embodiment, the apparatus according to the preceding embodiments, wherein the durable textured substrate is a hydroentangled base sheet.

In a thirty-eighth embodiment, the apparatus according to the preceding embodiments, wherein the substrate has a caliper of about or greater than 0.1 mm after activation of the substrate.

In a thirty-ninth embodiment, the apparatus according to the preceding embodiments, wherein the layer of the substrate is formed on a texture forming surface such that the layer has pockets into which expandable ink is printed.

In a fortieth embodiment, the apparatus according to the preceding embodiments, wherein the textured substrate comprises two or more layers wherein a design pattern is printed onto a portion of the top and/or bottom of the outer or inner layers of the substrate with an expandable ink and the printed design pattern portion is expanded with heat wherein the portion is defined as an area on the substrate whereby that area may be random or non-randomized In a forty-first embodiment, the apparatus according to the preceding embodiment, wherein the design pattern may be circles, squares, stars, one or more dots, lines, intersecting lines, rectangles, triangles, octagons, animals, teddy bears, clouds, signs, logos, human, animal or animated characters or any other similar design pattern thereof. Alternatively the design pattern for the apparatus may be a functional design.

In a forty-second embodiment, the apparatus according to the preceding embodiments, wherein the durable textured substrate portion (wherein the portion is defined as an area on the substrate whereby that area may be random or non-randomized) of the inner layers is activated by heating at a temperature from about 70 C to about 204 C.

In a forty-third embodiment, the apparatus according to the preceding embodiments, wherein the textured substrate is a nonwoven.

In a forty-fourth embodiment, the apparatus according to the preceding embodiments, wherein a wipe comprises the textured substrate.

In a forty-fifth embodiment, the apparatus according to the preceding embodiments, wherein the top side or back side of two or more layers of the durable textured substrate comprises hydrophilic fibers.

In a forty-sixth embodiment, the apparatus according to the preceding embodiments, wherein at least one layer of the substrate is formed on a texture forming surface such that the layer(s) have pockets into which expandable ink is printed.

In a forty-seventh embodiment, the apparatus according to the preceding embodiments, wherein the substrate comprises a multilayered tissue web or a multilayered airlaid nonwoven web.

In a forty-eighth embodiment, the apparatus according to the preceding embodiments, wherein the substrate comprises a multi layered uncreped through-air dried tissue web. The substrate may also comprise of a creped through-air dried tissue web.

In a forty-ninth embodiment, the apparatus according to the preceding embodiments, wherein the durable textured substrate is a hydroentangled base sheet.

In a fiftieth embodiment, the apparatus according to the preceding embodiments, wherein the substrate has a caliper of at about or greater than 0.1 mm after activation of the substrate.

In a fifty-first embodiment, the apparatus according to the preceding embodiments, wherein the two or more substrate layers have a density of between about 0.5 and 2.0 grams per cubic centimeters.

In a fifty-second embodiment, the apparatus according to the preceding embodiments, wherein the two or more substrate layers have a density of between about 0.05 and 0.15 grams per cubic centimeters.

In a fifty-third embodiment, the apparatus according to the preceding embodiments, wherein the substrate comprises at least one layer having a first density and any other layer or layers having a second density wherein the first density being at least 10%, 20% or 50% greater than the second density.

In a fifty-fourth embodiment, the apparatus according to the preceding embodiments, wherein the expandable ink is applied to an outer surface of the layer or layers having the second density and not applied to the outer surface of the layer with the first density.

In a further embodiment of the present disclosure, a textured substrate comprising two or more layers is disclosed. A design pattern is printed with an expandable ink onto a portion (wherein the portion is defined as an area on the substrate whereby that area may be random or non-randomized) of the top outer or bottom inner layers of the textured substrate and the textured substrate is expanded with heat.

In yet another embodiment, the apparatus and methods according to the preceding embodiments wherein the ink would be put on top of the airlaid. By putting the ink on top of the airlaid the ink would soak into the substrate and thus swell the web and give lift. By treating the top of the airlaid with ink is more preferred with a single layer wipe.

In yet a further embodiment, the apparatus and methods according to the preceding embodiments wherein the ink would be put on top of a hydroentangled top sheet. By applying the ink on top of the hydroentangled top sheet the ink would soak into the substrate and thus swell the web and give lift. By treating the top of the hydroentangled top sheet with ink is more preferred with a single layer wipe.

The above summary of the present disclosure is not intended to describe each embodiment or every implementation of the present disclosure. Advantages and attainments, together with a more complete understanding of the disclosure, will become apparent and appreciated by referring to the following detailed description and claims taken in conjunction with the accompanying drawings.

While the disclosure is amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the scope of the disclosure.

BRIEF DESCRIPTION OF DRAWINGS

The disclosure may be more completely understood in consideration of the following detailed description of various embodiments in connection with the accompanying drawing, in which.

Figure 1A:
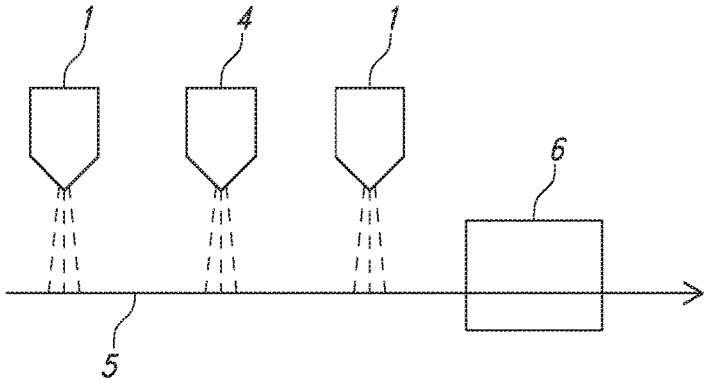
FIGS. 1*a* and *b* show two separate diagrams of a process for preparing a textured substrate.

While the disclosure is amenable to various modifications and alternative forms, specifics thereof have been shown by way of example in the drawing and will be described in detail. It should be understood, however, that the intention is not to limit aspects of the disclosure to the particular embodiments described. On the contrary, the intention is to cover all modifications, equivalents, and alternatives falling within the scope of the disclosure.

DETAILED DESCRIPTION OF THE DISCLOSURE

Each example of this disclosure is provided by way of explanation and is not meant as a limitation. For example, features illustrated or described as part of one embodiment or figure can be used on another embodiment or figure to yield yet another embodiment. It is intended that the present disclosure include such modifications and variations.

Although some suitable dimensions, ranges and/or values pertaining to various components, features and/or specifications are disclosed, one of skill in the art, incited by the present disclosure, would understand desired dimensions, ranges and/or values may deviate from those expressly disclosed.

When introducing elements of the present disclosure or the preferred embodiment(s) thereof, the articles "a", "an", and "the" are intended to mean that there are one or more of the elements.

The terms "comprising", "including" and "having" are intended to be inclusive and mean that there may be additional elements other than the listed elements. Many modifications and variations of the present disclosure can be made without departing from the spirit and scope thereof. Therefore, the exemplary embodiments described above should not be used to limit the scope of the invention.

The term "substrate" herein refers to woven or nonwoven tissue paper or any similar type of fibrous web used for consumer consumption.

The term "3-D' disclosed herein refers to a patterned substrate that is projected out (by expanding the ink) from its original base plane.

The term "expandable ink" herein refers to inks that include heat expandable particles dispersed in a solvent. The inks may also contain colorant such as one or more pigments or the inks may be tinted or dyed. The solvents can be any solvent commonly used in inks with the exception of styrene-based solvents. Water is a common solvent for these inks. Expandable inks are also referred to as "puff inks" or "puffing inks" herein.

The term "triggerable polymer" herein refers to polymers used as the binding agent in binders used for imparting integrity and tensile strength to fibrous webs such as airlaid webs that are intended to be disposed of, after use, by being flushed in a toilet. The integrity and tensile strength last throughout manufacture of the web through use of the web by the final user. However, upon disposal in a toilet, the change in environment triggers a loss of integrity and tensile strength in the fibrous web such that the web will break up in the sewer or septic system in a manner similar to bathroom tissue. An example of a triggerable binder is an ion-sensitive binder that maintains its integrity in a wetting solution with a relatively high salt concentration, but loses its integrity when the salt concentration is decreased by dilution in the water in a toilet and sewer system. Such a triggerable polymer is disclosed in U.S. Pat. No. 6,423,804.

The current disclosure provides a method for achieving durable texture in a substrate. By "durable," it is meant that the texture is maintained even when the substrate is wetted with water or a water-based solution or other solution that would cause the texture of a textured substrate to collapse unless additional supporting means (such as the expandable inks disclosed herein) were present as disclosed herein. The disclosure also provides for a large number of textured patterns that can be applied onto a substrate. Examples of the textured design patterns disclosed herein may be a circle, square, star, one or more dots, lines, intersecting lines, rectangles, triangles, octagons, animals, teddy bears, clouds, signs, logos, human, animal or animated characters or any other functional design pattern thereof. Such durable textured patterns are enabled through the application of expandable inks such as puffing inks which may be printed on to the substrate in liquid dispersion form in a desired pattern. The inked substrate may then be dried by any known drying technique in the art and further heated to an activation temperature, preferably between about 70 C to about 204 C wherein the textured structure is expanded or puffed.

As previously indicated once the inked substrate is dried it may further undergo heating at which time an expansion process occurs. During the expansion process the inked substrate is heated. Heating the inked substrate may be between about 70 C to about 204 C. During this time the entangled fibers in the inked substrate reposition as they dry to create a porous lofty structure around the ink creating a 3-D feel. The structure thus created does not collapse in the presence of water of a typical wipe solution. FIG. 1 depicts examples of two processes of the current disclosure. Per FIG. 1, there may be one or more coform banks. The drying oven can be used just for drying or drying and activation. If the drying oven was used just used for drying, there is a separate heating system to activate the expandable puff ink which can be in-line or off-line.

The ink may be applied in any pattern using any printing technique known in the art such as spraying, gravure, flexography or a digital method for example. The printed structure thickness is controlled by the amount of ink applied and/or the activation temperature.

Further, it is important to note that the more tightly packed fibers that are in a substrate the greater the density of that substrate. Therefore, to allow optimal penetration of the expandable ink, it would be preferable to print on the low density layer of a multi-layer substrate having layers of different density as compared to the high density layer. The low density layer provides softness and increased caliper compared with the high density layer of the substrate.

In general, the substrate structure, in final form, may contain the expanded ink on a portion of the top or bottom surface of the substrate. Additionally, the final 3-D like structure may be made without making the ink directly visible from outside. For example, if the expandable ink is applied to the substrate layer(s) portion with white, clear or opaque colors or the same color as the substrate portion layers wherein a portion described herein means that the expandable ink is applied in a purposeful pattern to portions (or areas) on the substrate.

Materials suitable for the substrates are well known to those skilled in the art, and are typically made from a fibrous sheet material which may be either woven or nonwoven. Suitable materials for use in the substrates may include nonwoven fibrous sheet materials which include tissue, meltblown, coform, airlaid, bonded-carded web materials, hydroentangled materials, spunlace materials, and combinations thereof. Such materials can be comprised of synthetic or natural fibers, or a combination thereof. In addition to nonwovens, the material of the substrate layers may be a tissue web such as a creped or uncreped through-air dried tissue web and/or an airlaid nonwoven web.

In an exemplary embodiment, the first outer layer of the substrate may be a tissue web, and more desirably, an uncreped through-air dried tissue web. The second outer layer of the substrate may be an airlaid nonwoven web.

Furthermore, coform nonwoven structures, which are composites of a matrix of meltblown fibers and a secondary fibrous material (e.g., pulp fibers), have been used as an absorbent layer in a wide variety of applications, including absorbent articles, absorbent dry wipes, wet wipes, and mops. Most conventional coform webs employ meltblown fibers formed from polypropylene homopolymers.

Additionally, a textured surface may be formed by contacting the meltblown fibers with a foraminous surface having three-dimensional surface contours. A forming surface for making textured substrates may be foraminous in nature so that fibers may be drawn into the openings of the surface and form dimensional cloth-like tufts projecting from the surfaces of the material that correspond to the openings in the forming surface. The foraminous surface may be provided by any material that provides sufficient openings for penetration by some of the fibers, such as a highly permeable forming belt. A specific example of the forming surface is a perforated polyurethane topped belt. A detailed disclosure such a forming surface used in a coform process is presented in US Patent publication number US2011/0152164 and U.S. Pat. No. 5,643,653 whereby both are incorporated herein.

Application of ink through a digital printing system may be preferred for printing on inner or multiple inner layers of the substrate but other ink applications known in the art may be used. Further, since the expandable ink (or puff ink) expands multiple times that of its original volume, one may get a lofty structure with lower basis weight than compared with a structure created with base substrate material alone.

The expandable inks are available in different color metrics so that the same process may be used to provide color hue to the substrate along with generating the structure. Any color maybe chosen or no color may effectively work such as a white or clear ink. Examples of expandable inks that may be used include but are not limited to Aqua Puff inks obtainable from Polytex Environmental inks. Suitable Aqua Puff inks include Puff Ink MW 4319 and MW 4404.

It is important to note that the substrate may be activated at any stage of product manufacturing by increasing the temperature to heat the substrate after the inked substrate is dried. So potentially the substrate may be activated at converting or even after the converting operation so that bulky material does not have to be transported to the substrate manufacturing from the converting operation.

The substrate may be formed from a single layer or multiple layers. In the case of multiple layers, the layers are generally positioned in a juxtaposed or surface-to-surface relationship and all or a portion of the layers may be bound to adjacent layers. The fibrous material may also be formed from a plurality of separate fibrous materials wherein each of the separate fibrous materials may be formed from a different type of fiber. In those instances where the fibrous material includes multiple layers, the binder composition may be applied to the entire thickness of the fibrous material, or each individual layer may be separately treated and then combined with other layers in a juxtaposed relationship to form the finished fibrous material. Desirably, the substrate may be formed from a single layer or ply.

Binder Composition in an Airlaid Process

In an airlaid process, a cleaning wipe substrate may include a binder composition. In one embodiment the binder composition may include a triggerable polymer. In another embodiment, the binder composition may comprise a triggerable polymer and a cobinder polymer.

The amount of binder composition present in the cleaning wipe substrate may desirably range from about 1 to about 15 percent by weight based on the total weight of the wipe substrate. More desirably, the binder composition may comprise from about 1 to about 10 percent by weight based on the total weight of the wipe substrate. Most desirably, the binder composition may comprise from about 3 to about 8 percent by weight based on the total weight of the wipe substrate. The amount of the binder composition results in a multi-ply wipe substrate that has in-use integrity, but quickly disperses when soaked in tap water.

A variety of triggerable polymers may be used as a binder composition. One type of triggerable polymer is a dilution triggerable polymer. Examples of dilution triggerable polymers include ion-sensitive polymers, which may be employed in combination with a wetting composition in which the insolubilizing agent is a salt. Other dilution triggerable polymers may also be employed, wherein these dilution triggerable polymers are used in combination with wetting agents using a variety of insolubilizing agents, such as organic or polymeric compounds.

To prepare the cleaning wipe substrates described herein, the binder composition may be applied to the fibrous material by any known process. Suitable processes for applying the binder composition include, but are not limited to, printing, spraying, electrostatic spraying, air atomization spraying, the use of metered press rolls, or impregnating. The amount of binder composition may be metered and distributed uniformly onto the fibrous material or may be non-uniformly distributed onto the fibrous material.

Once the binder composition is applied to the fibrous material, drying, if necessary, may be achieved by any conventional means. Once dry, the wipe substrate may exhibit improved tensile strength when compared to the tensile strength of the untreated wet-laid or dry-laid fibrous material, and yet should have the ability to rapidly "fall apart" or disintegrate when placed in tap water.

For ease of application to the fibrous substrate, the binder composition may be dissolved in water, or in a non-aqueous solvent, such as methanol, ethanol, acetone, or the like, with water being the preferred solvent. The amount of binder dissolved in the solvent may vary depending on the polymer used and the fabric application. Desirably, the binder solution contains less than about 18 percent by weight of binder composition solids. More desirably, the binder solution contains less than 16 percent by weight of binder composition solids.

The finished cleaning wet wipes may be individually packaged, desirably in a folded condition, in a moisture proof envelope or packaged in containers holding any desired number of sheets in a water-tight package with a wetting composition applied to the wipe. Some example processes which can be used to manufacture folded wet wipes are described in U.S. Pat. Nos. 5,540,332 and 6,905,748, which are incorporated by reference herein. The finished wipes may also be packaged as a roll of separable sheets in a moisture-proof container holding any desired number of sheets on the roll with a wetting composition applied to the wipes. The roll can be coreless and either hollow or solid. Coreless rolls, including rolls with a hollow center or without a solid center, can be produced with known coreless roll winders, including those of SRP Industry, Inc. of San Jose, Calif.; Shimizu Manufacturing of Japan, and the devices disclosed in U.S. Pat. No. 4,667,890. U.S. Pat. No. 6,651,924 also provides examples of a process for producing coreless rolls of wet wipes.

In addition to the cleaning wipe substrate, wet wipes also contain a wetting composition described herein. The liquid wetting composition can be any liquid, which can be absorbed into the wet wipe basesheet and may include any suitable components, which provide the desired wiping properties. For example, the components may include water, emollients, surfactants, fragrances, preservatives, organic or inorganic acids, chelating agents, pH buffers, or combinations thereof, as are well known to those skilled in the art. Further, the liquid may also contain lotions, medicaments, and/or antimicrobials.

The wetting composition may desirably be incorporated into the wipe in an add-on amount of from about 10 to about 600 percent by weight of the substrate, more desirably from about 50 to about 500 percent by weight of the substrate, even more desirably from about 100 to about 500 percent by weight of the substrate, and especially more desirably from about 200 to about 300 percent by weight of the substrate.

In the case of a dispersible, wipe, the wetting composition for use in combination with the wipe substrate may desirably comprise an aqueous composition containing the insolubilizing agent that maintains the coherency of the binder composition and thus the in-use strength of the wet wipe until the insolubilizing agent is diluted with tap water. Thus the wetting composition may contribute to the triggerable property of the triggerable polymer and concomitantly the binder composition.

The insolubilizing agent in the wetting composition may be a salt, such as those previously disclosed for use with the ion-sensitive polymer, a blend of salts having both monovalent and multivalent ions, or any other compound, which provides in-use and storage strength to the binder composition and may be diluted in water to permit dispersion of the wet wipe as the binder composition transitions to a weaker state. The wetting composition may desirably contain more than about 0.3 weight percent of an insolubilizing agent based on the total weight of the wetting composition. The wetting composition may desirably contain from about 0.3 to about 10 weight percent of an insolubilizing agent based on the total weight of the wetting composition. More desirably, the wetting composition may contain from about 0.5 to about 5 weight percent of an insolubilizing agent based on the total weight of the wetting composition. More desirably, the wetting composition may contain from about 1 to about 4 weight percent of an insolubilizing agent based on the total weight of the wetting composition. Even more desirably, the wetting composition may contain from about 1 to about 2 weight percent of an insolubilizing agent based on the total weight of the wetting composition.

The wetting composition may desirably be compatible with the triggerable polymer, the cobinder polymer, and any other components of the binder composition. In addition, the wetting composition desirably contributes to the ability of the wet wipes to maintain coherency during use, storage and/or dispensing, while still providing dispersibility in tap water.

Alternatively, the wet wipes may be prepared using a wipe substrate with a fibrous material and a binder composition forming a nonwoven airlaid web. These wet wipes made with the wipe substrate may also be made to be usable without breaking or tearing, to be consumer acceptable, and provide problem-free disposal once disposed in a household sanitation system. The wet wipes may also be prepared using a coform substrate as described above.

EXAMPLES

Figure 1B:
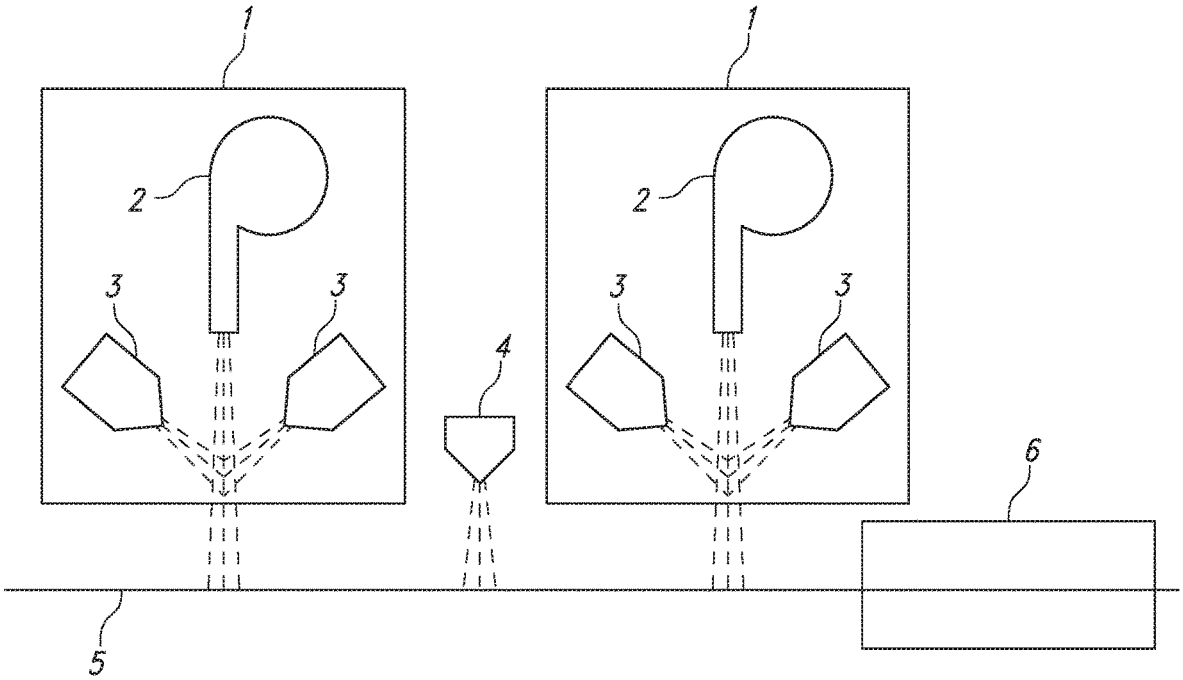

FIGS. 1*a* and *b* show two processes for making a substrate. FIG. 1*a* depicts a process beginning from the left depicting a coform system (1), printing system (4), a coform web (5) and a drying and/or heating oven (6). FIG. 1*b* shows a process beginning on the left to right depicting coform system (1), absorbent fiber system (2); melt blown system (3), printing system (4), coform web (5) and drying and/or heating oven (6).

Figure 2A:
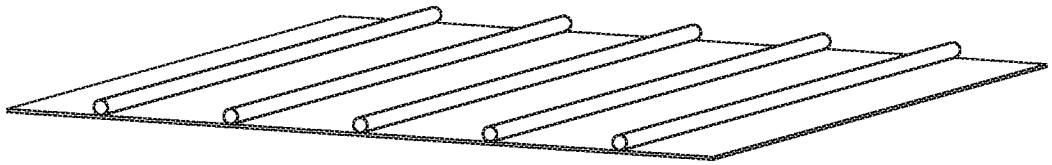
FIGS. 2*a-d* show cross-sectional views depicting different ways an expandable ink may be printed onto a substrate.
Figure 2B:
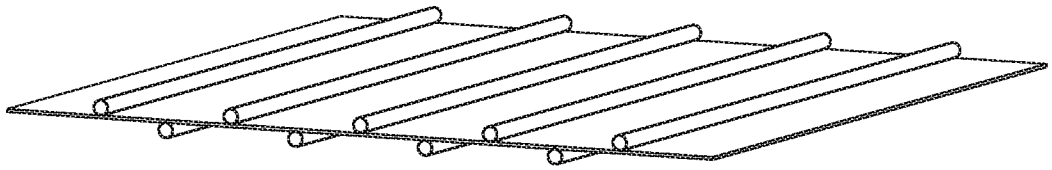
Figure 2C:
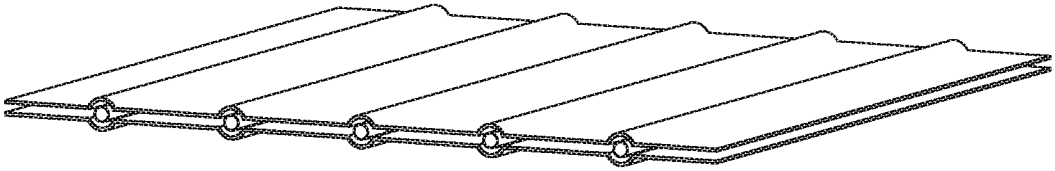
Figure 2D:
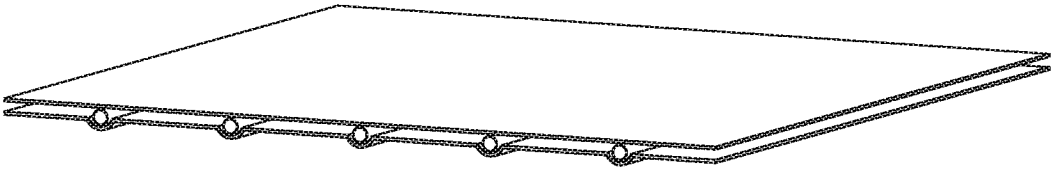

One example depicted herein applies aqua puff inks on to a coform sheet and then heated in oven at about 104 C for about ten minutes, to create an expanded structure. FIGS. 2*a-d* depicts cross-section views of where the textured expandable ink may appear on a substrate. FIG. 2*a* depicts a substrate with puffing ink printed on a top surface. FIG. 2*b* shows a substrate with puffing ink printed on top and bottom surfaces. FIG. 2*c* shows a two-layer substrate with puffing ink printed on top of a bottom layered substrate. FIG. 2*d* shows a two-layer substrate with puffing ink printed into pockets in the bottom layer of the substrate.

The process and result provided a method of creating resilient texture with a predefined desired pattern using heat activated expansion of the substrate material.

Caliper and Density Measurements

The caliper as used herein is the thickness of a single substrate sheet, but measured as the thickness of a stack of ten sheets and dividing the ten substrate sheet thickness by ten, where each sheet within the stack is placed with the same side up. Caliper is expressed in millimeters. It is measured in accordance with TAPPI test methods T402

"Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The millimeter used for carrying out T411 om-89 is a Bulk Millimeter (TMI Model 49-72-00, Amityville, N.Y.) having an anvil diameter of 4 1/16 inches (103.2 millimeters) and an anvil pressure of 220 grams/square inch (3.3 g kiloPascals). After the Caliper is measured, the same ten sheets in the stack are used to determine the average basis weight of the sheets.

The density of the tissue is calculated by dividing its basis weight by its caliper.

Figure 3:
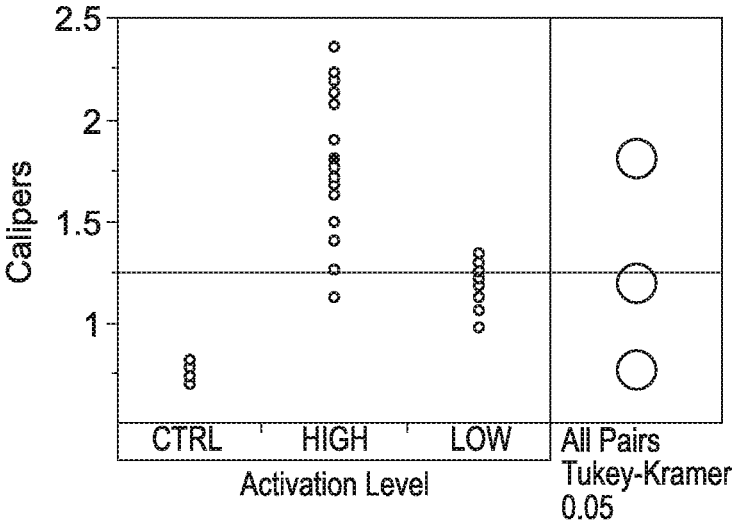
FIG. 3 is a plot depicting caliper versus activation level.

FIG. 3 shows the results of the analysis of caliper measurements taken on each designated code, A B or C. Each code had a statistically different average caliper, therefore each puff ink code has a statistically higher thickness than the current basesheet. By manipulation puff ink addition, type and pattern, substrate sheet caliper may be significantly increased.

If a coform process is undertaken herein the average thickness of the substrate after activation may be from about 0.5 to about 30 millimeters. For other known types of similar process such as airlaid, the thickness after activation disclosed herein is between about 0.10 and 0.40 mm or a caliper improvement of 18% to 76% which increases cloth like and durability perception. Overall using such processes, the size area for the design pattern on the textured substrate disclosed herein may be between 5-50%.

Airlaid Versus UCTAD Layer

Figure 4:
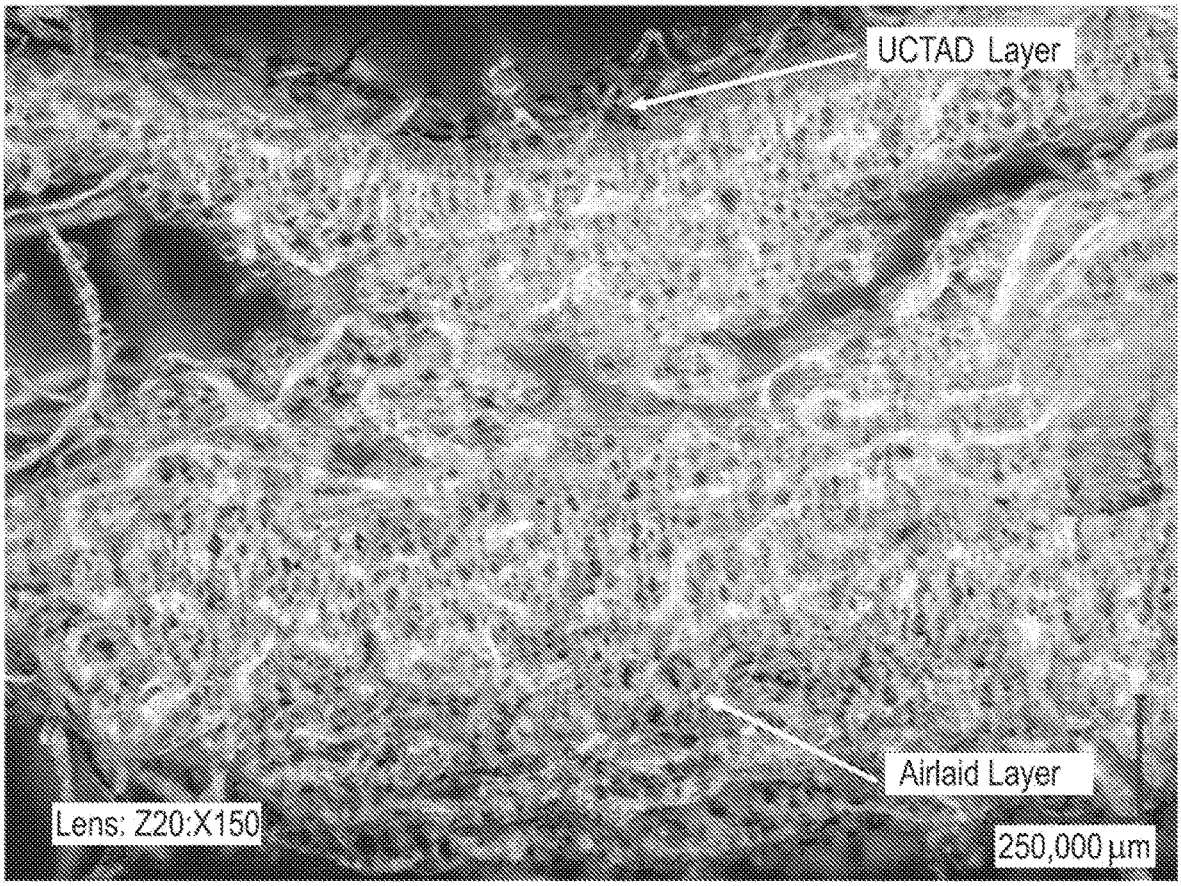
FIG. 4 shows expandable ink applied to the airlaid side of a basesheet.

When making samples with puff inks, a noticeable difference was observed when applying the ink to opposite sides of the substrate basesheet. When the ink is applied to the airlaid layer of a basesheet as shown in FIG. 4, the ink fully saturates the airlaid layer and penetrates into the UCTAD layer. The microspheres seen in the picture of FIG. 4 are the puffing agent in the ink, so the puffing agent has penetrated to the surface of the other layer when applied to airlaid.

Figure 5:
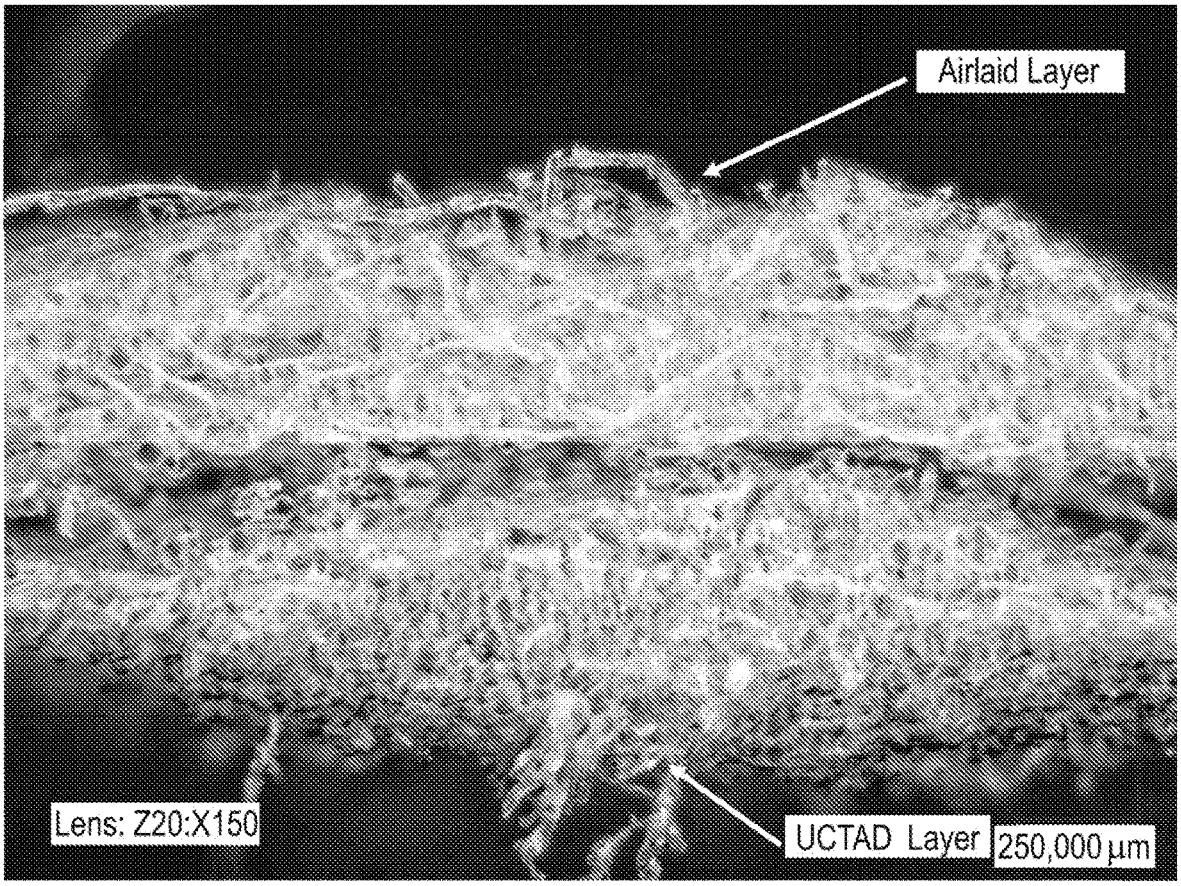
FIG. 5 shows microspheres that have fully saturated the UCTAD layer, but do not fully penetrate into the airlaid layer.

When the ink is applied to the UCTAD layer of the basesheet, the puffing is not as drastic. FIG. 5 shows that the microspheres have fully saturated the UCTAD layer, but do not fully penetrate into the airlaid layer.

Figure 6:
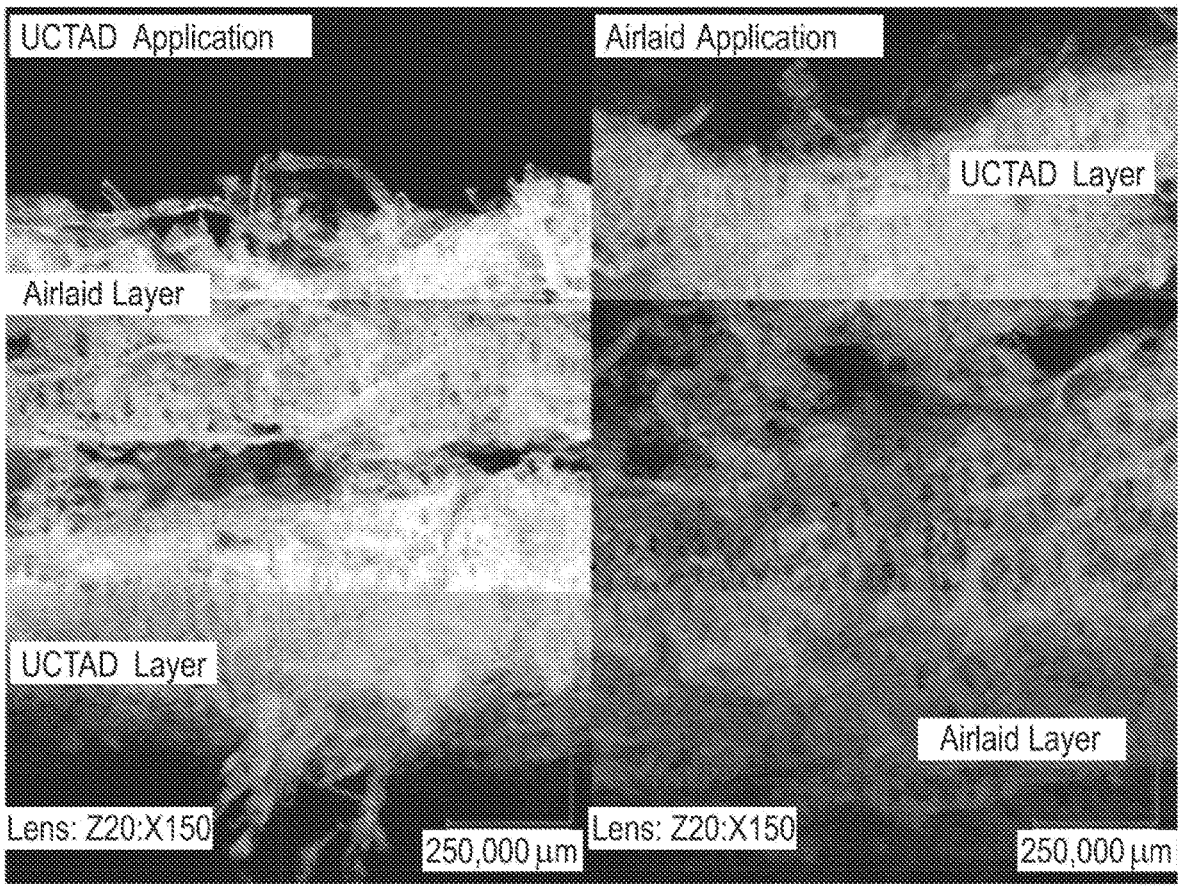
FIG. 6 shows the UCTAD application next to the airlaid application.

A noteworthy observation that comes from this difference is that the UCTAD application does not puff as high as the airlaid application, even though the same amount of ink was applied to the substrate sheets. FIG. 6 shows the UCTAD application next to the airlaid application. Both pictures are to the same scale, so the visible difference in puffing between the two pictures is accurate.

In summary, applying the puff ink to the airlaid layer of the composite basesheet gives a greater level of activation and subsequently more noticeable texture.

All documents cited in the Detailed Description are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by references, the meaning or definition assigned to the term in this written document shall govern.

Those skilled in the art will recognize that the present disclosure may be manifested in a variety of forms other than the specific embodiments described and contemplated herein. Specifically, the various features described with respect to the various embodiments and figures should not be construed to be applicable to only those embodiments and/or figures. Rather, each described feature may be combined with any other feature in various contemplated embodiments, either with or without any of the other features described in conjunction with those features. Accordingly, departure in form and detail may be made without departing from the scope of the present disclosure as described in the appended claims.

What is claimed is:

1. A method comprising:

providing a textured substrate comprising at least one layer having a first density and at least one layer having a second density, wherein the first density is at least 10% greater than the second density, wherein the at least one layer having the second density comprises an airlaid nonwoven web;

printing a design pattern on an outer surface of the airlaid nonwoven web with an expandable ink and not on an outer surface of the at least one layer having the first density; and activating the design pattern on the textured substrate with heat.

2. The method according to claim 1, wherein the design pattern may be a circles, one or more dots, squares, stars, lines, intersecting lines, rectangles, triangles, octagons, animals, teddy bear, frogs, clouds, signs, logos, human, animal or animated characters, or icons.

3. The method according to claim 1, wherein the design pattern is functional.

4. The method according to claim 1, wherein activation occurs immediately after drying.

5. The method according to claim 1, wherein activation occurs when the textured substrate is packaged in a final product form.

6. The method according to claim 1, wherein activation occurs anytime between after drying and when the textured substrate is packaged in a final product form.

7. The method according to claim 1, wherein the expandable ink is printed in a liquid dispersion form.

8. The method according to claim 1, wherein the expandable ink is printed by spraying, screen printing, gravure, flexography, or a digital printing system.

9. The method according to claim 1, wherein the textured substrate is dried by Infrared (IR), microwave, heated embossing roll, hot iron, steam, hot air, or UV radiation.

10. The method according to claim 1, wherein the heat of the activation step is at a temperature from about 70° C. to about 204° C.

11. The method according to claim 1, wherein the textured substrate has a caliper of at least about 0.1 mm after the activation step.

12. A wipe comprising the textured substrate accordingly to claim 1.

13. A method comprising:

printing a design pattern with an expandable ink onto a surface of an airlaid web of a substrate comprising the airlaid web and at least one other layer, wherein the airlaid web has a density at least 10% less than the at least one other layer;

drying the design patterned substrate;

activating the design patterned substrate with heat.

14. The method according to claim 13, wherein the outer surface comprises hydrophilic fibers.

15. The method according to claim 13, wherein the substrate has a caliper of at least about 0.1 mm after the activation step.

16. A wipe comprising the ubstrate accordingly to claim 13.

* * * * *